US005174673A

United States Patent [19]

Gruner

[11] Patent Number: 5,174,673

[45] Date of Patent: Dec. 29, 1992

[54] COSMETIC STICK HOLDER WITH LOCKING PROJECTION

[75] Inventor: Claus Gruner, Bad Blankenburg, Fed. Rep. of Germany

[73] Assignee: Rocma Concepts GmbH Beratung und Vertrieb für Die Kosmetische Industrie, Bad Blankenburg, Fed. Rep. of Germany

[21] Appl. No.: 833,784

[22] Filed: Feb. 12, 1992

[51] Int. Cl.[5] ..... A45D 40/06; A45D 40/12

[52] U.S. Cl. ..... 401/78; 401/74; 401/86; 401/87

[58] Field of Search ..... 401/74, 78, 79, 86, 401/87

[56] References Cited

U.S. PATENT DOCUMENTS

| | | | |
|---|---|---|---|
| 1,306,179 | 6/1919 | Grant | 401/78 |
| 3,002,611 | 10/1961 | Doblin | 401/78 |
| 3,380,795 | 4/1968 | Gruska | 401/78 |
| 3,709,618 | 1/1973 | Gruska | 401/78 |

FOREIGN PATENT DOCUMENTS

| | | | |
|---|---|---|---|
| 1197440 | 7/1970 | United Kingdom | 401/86 |
| 1298934 | 12/1972 | United Kingdom | 401/78 |
| 1380625 | 1/1975 | United Kingdom | 401/78 |

*Primary Examiner*—Steven A. Bratlie
*Attorney, Agent, or Firm*—Beveridge, DeGrandi & Weilacher

[57] ABSTRACT

In a cosmetic stick holder, especially a lip stick holder, the slot sleeve (2) of the cosmetic stick mechanism containing the cosmetic stick is locked with its foot part (3) in an outer cap member (8) by an easily releasable lock (9, 10), whereas an elastic tongue (20) having a locking projection (21) extending radial outwardly projects from the bottom side of the piston (1) carrying the cosmetic stick, wherein the locking projection (21), in the starting position of the piston (1), is radially aligned with a locking opening (22) provided in the circumferential wall (24) of the foot part (3) and shaped for the engagement of the locking projection (21) and, in the starting position of the piston (1), is held by a radial projection (9) provided at the inner wall of the outer cap member (8) against the spring force of the elastic tongue (20) without engagement with the locking opening (22).

17 Claims, 1 Drawing Sheet

COSMETIC STICK HOLDER WITH LOCKING PROJECTION

The invention relates to a cosmetic stick holder comprising a piston for carrying the cosmetic stick, the piston being displaceable in a slot sleeve which is rotatable in a screwing sleeve and comprises a longitudinal slot through which a lug formed at the piston extends up into a thread groove formed in the screwing sleeve, wherein the slot sleeve extends out of the screwing sleeve to form a foot part being held in an outer cap member, from which the screwing sleeve projects in turn rotatably, in such a way, that the piston is displaceable in the slot sleeve towards the end of the slot sleeve opposite to the foot part by rotating the screwing sleeve relative to the outer cap member in one rotating direction and is displaceable in the slot sleeve back towards the foot part up to a starting position in the other rotating direction of the screwing sleeve.

By such a displacement of the piston by rotating the screwing sleeve relative to the outer cap member the cosmetic stick, which can be a lipstick, a deodorant stick or the like, and which is supported with its foot by the piston shaped e.g. as a cup, is moved out of the open end of the slot sleeve and, upon opposite rotation is retracted into the slot sleeve again. The outer cap member serves as the lower part of a protective casing, which in most cases is designed as a decor casing. In order to hold the foot of the slot sleeve in the outer cap member with a simultaneous rotatability of the screwing sleeve relative to the outer cap member a central socket can be mounted at its bottom, a socket which engages quite firmly into a central hole of the foot part. This, however, has the consequence that the assembly locked in the outer cap member and called herein as "cosmetic stick mechanism" can only be released with effort and strength after the consumption of the cosmetic stick, and therefore the outer caps are in general thrown away with the empty cosmetic stick mechanism and thus the outer caps were prevented from being designed as relatively precious ornaments.

If, on the other hand, the cosmetic stick mechanism is produced and distributed unaltered as an exchange assembly, so that the outer cap members can be used again, the cosmetic stick can also be moved out of the slot sleeve by turning the screwing sleeve relative to the foot part projecting out of the latter, so that in many cases the purchaser does not have the guarantee that the cosmetic stick bought has not been used.

By means of the invention there is solved the problem of designing a cosmetic stick holder in a way that the cosmetic stick mechanism outside the outer cap member is to a large extent not functionable for moving out the cosmetic stick, but functionable within the outer cap member.

According to the invention, the slot sleeve with its foot part is locked in the outer cap member by an easily releasable lock and an elastic tongue having a locking projection extending radial outwardly is formed at the piston and projects beyond the bottom side of the piston, wherein the locking projection, in the starting position of the piston, is radially aligned with a locking opening provided in the circumferential wall of the foot part and shaped for the locking engagement of the locking projection and is held by a radial projection provided at the inner wall of the outer cap member against the spring force of the elastic tongue out of engagement with the locking opening.

Outside the outer cap member the locking projection of the elastic tongue of the piston lockingly engages in the starting position thereof, in which the cosmetic stick is completely retracted into the slot sleeve, into the locking opening formed in the wall of the foot part, by means of which the piston is locked in its starting position against an axial displacement in the slot sleeve, and therefore also the screwing sleeve and the slot sleeve are blocked against a relative turning movement by means of the lug of the piston engaging into the thread groove of the screwing sleeve. By mounting the cosmetic stick mechanism into the outer cap member, however, the locking projection is raised out of the locking opening by the radial projection of the outer cap member, enabling the piston to be free for the axial shifting in the slot sleeve, and the screwing sleeve to be free for the relative turning relative to the slot sleeve, without any further measures. When the slot sleeve relatively turns in the screwing sleeve, the locking projection slides on the smooth inner surface of the slot sleeve, but is prevented by the radial projection from lockingingly engaging into the locking opening, when the piston reaches again its starting position. However, it is possible here that the raised locking projection in the starting position of the piston still engages into the locking opening in a slight snapping position, so that by the slight snapping of the locking projection into the locking opening the user can recognize the moment when the piston has reached again its starting position.

At the radial projection and/or the locking projection there can be shaped an inclined surface where the radial projection and the locking projection run against each other during the mounting operation in order to favor the raising of the locking projection out of the locking opening.

The locking projection can e.g. be an axially positioned rib at the inner wall of the outer cap member, the rib being pushed into an axial groove of the foot member when the foot member is axially inserted into the outer cap member, the locking opening opens into the axial groove, so that the locking projection is raised out of the locking opening from the end of the rib averse to the cap bottom of the outer cap member. In the groove the rib forms at the same time a catch against rotation for the foot part in the outer cap member, by means of which the lock between both of them has only to be shaped as a relatively easily movable axial lock, e.g. by mounting radially springing snapping shackles centrally at the cap bottom of the outer cap member, the shackles snapping springingly behind the edge of a central opening in the bottom of the foot part.

In another embodiment which is preferred at the moment there is formed—at the foot part—an axial shoulder as a seat for the radial projection, which is axially lockable at the axial shoulder by a relative turning movement of the outer cap member on the one hand and of the foot part by means of the screwing sleeve on the other hand, wherein axially between the two construction parts comprised of the foot part and the outer cap member one construction part is formed with an elastic member being positioned between the construction parts and pushing the construction parts axially apart. Further, in this embodiment, the locking opening is located above the axial shoulder and is bordered by the axial shoulder.

In this embodiment of the invention there is therefore provided a bayonetlike locking device between the outer cap member and the foot part, wherein the radial projection and the axial shoulder can be held in a sufficiently strong mutual engagement because of the elastic force of the elastic member, so that the screwing sleeve can be rotated for the use of the cosmetic stick relative to the outer cap member and thus to the slot sleeve without an unintended releasing of the locking by rotating back the foot part. In this embodiment, the axial shoulder is averted from the cap bottom of the outer cap member and is axially overlapped by the radial projection. Even if also in this embodiment the radial projection could be shaped as an axially extending rib, its shape as a plug, especially as a round plug, is preferred.

The elastic member can e.g. be shaped as an elastic vault of the bottom of the outer cap member or of the foot part of the slot sleeve. Further, it is possible to form one or more projections at the inner side of the bottom of the outer cap member and to provide the elastic member as a springingly yielding bottom of the foot part. This possibility is especially suitable, if the outer cap member is deep drawn of a metal material and if the projections at the cap bottom are formed by depression, whereas the foot part is produced from a plastics material and can be springingly deformed by means of the projections. It is possible, too, that the elastic member is formed as an elastically yielding tongue formed at one of the construction parts, comprising a projection arranged eccentrally with respect to the rotating axis of the screwing sleeve, the preferably rounded projection engaging into a ccmplimentary locking recess of the other construction part. Hereby, an additional protection against rotation of the foot part is achieved, which enables the elastic member to be designed for little spring tension. This possibility for designing the elastic member is preferred if the outer cap member is made of plastic material.

The mutually engaging surfaces of the radial projection and of the axial shoulder can be plane-shaped, if the frictional force between them in the locking position is sufficient in order to prevent their unintended turning apart with the rotating of the screwing sleeve, or the foot part is held back by other means, such as by the above mentioned rotating protection mechanism via the elastic tongue against a rotating of the screwing sleeve when it is normally operated. A measure of this kind, which is indeed preferred, is that the axial shoulder is shaped as a snapping depression and the radial projection is shaped as a round lug, so that even here in this locking position there is a certain closing form or positive engagement against a rotation of the foot part. This closing form can, however, be overcome for an intended unlocking of the foot part on the grounds of the yielding of the elastic member.

In a preferred development of the invention the construction part comprising the axial shoulder has a guiding groove opening at one side of the axial shoulder for the radial projection formed as a round lug, the groove being axially open at the end opposite to the axial shoulder and from the groove the round lug can be turned out until it engages the axial shoulder and the locking projection. In a further development of this embodiment, there is provided a second guiding groove for the round lug at the other side of the axial shoulder, the second guiding groove being axially open at the end opposite to the axial shoulder and into which the round lug can be rotated out of engagement with the axial shoulder and with the locking projection. The second guiding groove is shaped at that side of the axial shoulder which is opposite to the rotating direction of the screwing sleeve when the piston is displaced back towards the foot part. Hereby it is possible to execute the locking of the foot part in the outer cap member as also the unlocking of the same by rotating movements in the same rotation direction.

Preferably, two elastic tongues according to the invention, being diametrically opposed, are formed at the piston, both tongues engaging with a locking projection in the starting position of the piston into a locking opening in the circumferential wall of the foot part, if the cosmetic stick mechanism is outside the outer cap members. The radial free front ends of the locking projections end in the corresponding locking opening with a distance from the external surface of the foot part. Therefore, the locking projections for the unlocking of the cosmetic stick are not easily accessible from the outside, but except if a special tool is used. In order to prevent this, too, it is proposed furthermore to cover the locking opening or at least one of the locking openings at the radially outer side with a shaped thin plastic skin or the like before the foot part is inserted into the outer cap member for the first time, wherein the skin can be destroyed by the radial projection when the foot part is inserted into the outer cap member. By this, by the existence of an undestroyed skin a reliable proof of originality is created which clearly shows that the cosmetic stick has not been used yet.

BRIEF DESCRIPTION OF THE DRAWINGS

The invention is explained by means of a presently preferred embodiment, which is evident at least schematically in the drawings. In the drawings.

DETAILED DESCRIPTION OF A PREFERRED EMBODIMENT

Figures 1, 2, 3:
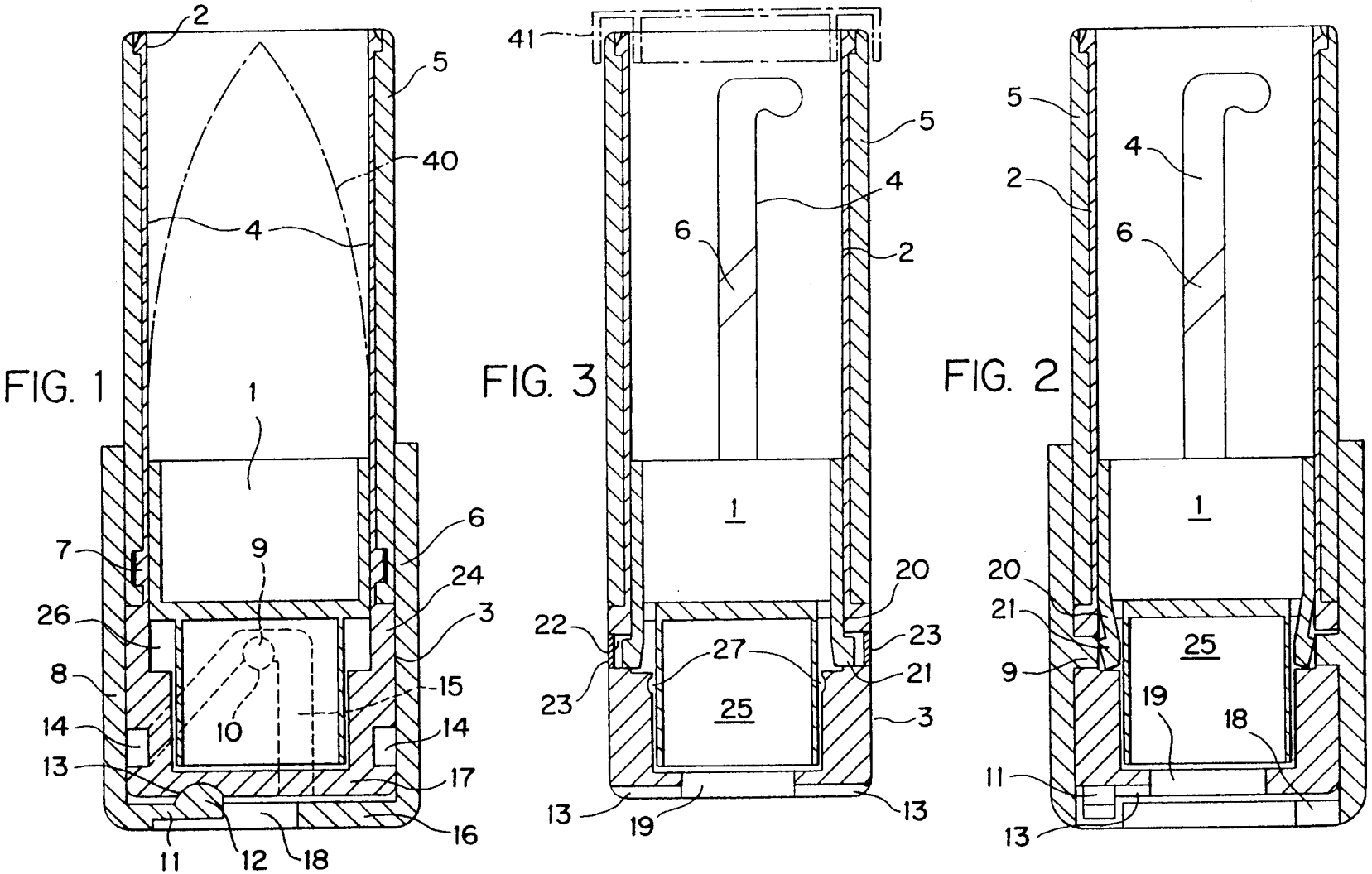
FIG. 1 and 2 show different axial sections of a cosmetic stick holder with a cosmetic stick mechanism in an outer cap member according to the first preferred embodiment of the invention.
FIG. 3 shows an axial section of the cosmetic stick mechanism of FIG. 2, but before its insertion into the outer cap member.

As it is shown in FIGS. 1-3, a cup-shaped piston 1 carrying the cosmetic stick (not shown) is movable in a slot sleeve 2 which itself is rotatably contained in a screwing sleeve 5. In the slot sleeve 2 two diametrically opposed longitudinal slots 4 are formed. In the inner walls of the screwing sleeve 5 there are formed two opposed thread grooves 6 with a relatively great pitch. The piston 1 has at its external wall two diametrically opposed lugs 7 projecting in radially outward direction, which extend through the longitudinal slots 4 of the slot sleeve 2 up into the corresponding thread groove 6 of the screwing sleeve 5. Therefore, when the screwing sleeve 5 is rotated about the slot sleeve 2, the lugs 7 are moved in the longitudinal slots 4 by the trailing edge of the corresponding thread groove 6 whereby the piston 1 is axially shifted in the slot sleeve 2 and therefore the cosmetic stick is moved out of the open end of the slot sleeve 2, and, respectively, is moved back into the slot sleeve 2 upon opposite rotation.

In the embodiment shown in FIGS. 1 to 3 as a preferred example, the slot sleeve 2 axially extends beyond the screwing sleeve 5 with a cup-shaped foot part 3 with a central opening 19 in the bottom 17 of the foot part 3, whereby the slot sleeve 2 can be rotated relatively to the screwing sleeve 5 by means of engagement at the same and furthermore at the foot part 3. The external diameter of the foot part 3 corresponds to that of the screwing sleeve 5. The lower section of the circumferential wall 24 of the foot part 3 is thickened at the inner side. From the lower surface of piston 1 extends a cylinder projection 25, the external diameter of which is less than that of the piston 1, projects in the lowest position of the piston 1—as it is shown in the drawing—into the cylinder space, which is bordered by the thicker section of the circumferential wall of the foot part 3, and engages according to FIG. 3 in this lowest position into the thicker section of the circumferential wall with small snapping knobs 27 in snapping recesss 28, so that it is recognizable by the snapping of the snapping knobs 27 and the snapping recesss one into the other when the piston 1 has reached its lowest position.

The cosmetic stick mechanism is inserted with the foot part 3 of the slot sleeve 2 and the lower part of the screwing sleeve 5 into an outer cap member 8 shaped in the example like a cylindrical pot (other shapes thereof are possible, too), in which the screwing sleeve is rotatable, but in which the foot part 3, is held axially and against rotation. To this purpose, two radial projections shaped as round lugs 9 are formed at the inner wall of the outer cap member 8 at a distance from the cap bottom 16 and diametrically opposed with respect to the outer cap member 8. At the external circumference of the foot part 3 there is formed for each of the round lugs 9 a guiding groove 14 extending in its circumferential wall 24 obliquely to the axial direction, the lower end of the groove being axially open at the lower side of the bottom of the foot part. The guiding groove 14 is closed at its radial bottom along the thicker section of the circumferential wall of the foot part 3 and extends above the thicker section of the circumferential wall as a radial slot and opens at one side of an axial shoulder 10, which is shaped as a snapping hollow for the corresponding round lug 9 and is axially pointing to the open end of the outer cap member 8. A second guiding groove 15, which is axially positioned in the circumferential wall 24 of the foot part 3 and which is also open at the lower side of the foot part, opens at the other side of the axial shoulder 10.

Elastic tongues 11 are formed in the cap bottom 16 at the periphery thereof, the tongues 11 having a rounded projection 12 positioned eccentrically with respect to the cap axis, the projection protruding at the inner side of the cap bottom 16. The projections 12 are opposed diametrically to the outer cap member 8. At the lower side of the bottom 17 of the foot part 3 there are formed in the latter two recesses 13 being diametrically opposed, which interact with the projections 12 for the snapping of the foot part 3 against rotation, when the cosmetic stick mechanism is set into the outer cap member 8. The elastic tongues 11 additionally serve to press apart the cap member 8 and the foot part 3 thereby pressing the round lugs 9 into their seats 10.

In the embodiment shown, the outer cap member 8 is an injection moulded part of plastics material. In the area of the periphery of the bottom 16 of the cap member 8 there are shaped two openings 18, each of which is axially aligned with one of the round lugs 9, so that the lower side of the round lugs 9 can be formed by means of bar-shaped tool slides during the injection moulding of the outer cap member. Also, the lateral contours of the elastic tongues 11 are formed by the tool slides.

For inserting the cosmetic stick mechanism into the outer cap member 8 the cosmetic stick mechanism is turned with its foot part 3 into the outer cap member 8 in that direction which corresponds to the relative turning of the screwing sleeve 5 relative to the slot sleeve 2 for retracting the piston 1 into the slot sleeve 2. Hereby, the round lugs 9 of the outer cap member 8 enter into the open ends of the oblique guiding grooves 14 and are displaced in the guiding grooves 14 upon the further turning movement, until the round lugs 9 snap into the depression of the axial shoulder 10. Under the spring force of the elastic tongues 11 the round lugs 9 are held back in the depression of the axial shoulders 10 against a further turning movement. At the same time, the projections 12 of the elastic tongues 11 have snapped into the corresponding recesses 13. The result is that the foot part 3 is held back axially at the axial shoulder 10 and is held against rotation in the cap member 8 under the spring force of the elastic tongues 11 due to the hollow form of the axial shoulders 10 and the snapping engagement of the projections 12 of the elastic tongues 11 into the corresponding recesses 13. Thereby, the piston 1 can be displaced by turning the screwing sleeve 5 with respect to the outer cap member 8 and thus to the slot sleeve 2 for moving the cosmetic stick out of and into the slot sleeve 2, respectively, without releasing the foot part 3 from the outer cap member 8. If, however, the piston 1 is in the position in which it is pushed farthest into the slot sleeve 2, the locking of the cosmetic stick mechanism can be released by a further turning of the screwing sleeve 5 with respect to the outer cap member 8 in the same turning direction, whereby the round lugs 9 enter into the second guiding groove 15, and the cosmetic stick mechanism can axially be drawn out of the outer cap member 8.

In the extension of the circumferential wall of the cup-shaped piston 1 there are mounted at the piston 1 two elastic tongues 20 pointing downwards, which are positioned in the ring space 26 between the cylinder projection 25 and the upper section of the circumferential wall 24 of the foot part 3, and each of them is equipped with a locking projection 21 at the radially external side. The elastic tongues 20 engage with their locking projections 21 into the locking openings 22 formed above the axial shoulder 10, if the cosmetic stick mechanism is not locked in the outer cap member 8. The locking projections 21 end with their radial front sides radially at a distance from the external circumferential surface of the foot part 3 and are therefore sunk in the locking openings 22 when seen from the outside. By the locking of the cosmetic stick mechanism in the outer cap member 8, however, the locking projections 21 at the elastic tongues 20 are pushed out of engagement with the locking openings 22 by the round lugs 9, whereby the slot sleeve 2 and the screwing sleeve 5, be rotated with respect to each other, after the cosmetic stick mechanism has been inserted. An oblique shoulder can be formed at the radial projections 9 and/or at the locking projections 21 of the elastic tongues 20 in order to push the locking projections 21 out of the locking openings 22, the oblique shoulder fascilitating the pushing out of the locking projections 21. Above the locking opening 22, there can be formed a small skin 23, as shown in FIG. 3, which is destroyed when the round lug 9 is turned into the axial shoulder 10. Thereby, a proof of originality is created which shows that with an undestroyed skin 23 the cosmetic stick in the cosmetic stick mechanism outside the outer cap member 8 has not yet been used.

As shown in FIG. 1 with dash and dot lines, the cosmetic stick can be provided, as known in the art, with a protection sleeve 40, which releases itself from the cosmetic stick after the first moving out of the piston 1. Additionally or alternatively it is possible, as shown in dash and dot lines in FIG. 3, to cover the open end of the cosmetic stick mechanism with a releasable protection cover 41.

I claim:

1. A cosmetic stick holder, comprising:

a piston that is adapted to support a cosmetic stick and which includes a lug;

a slot sleeve which includes a longitudinal slot and an internal hollow within which hollow said piston is positioned;

a screwing sleeve having a first end, a second end and a threaded groove, said screwing sleeve being positioned external to the slot formed in said slot sleeve such that said lug extends through said slot sleeve and into said threaded groove, and said slot sleeve including a foot part which extends away from the second end of said screwing sleeve;

an outer cap member having a radial projection extending inwardly off of said outer cap member, said outer cap member further including an interior recess which receives said foot part, and said screwing sleeve being adapted for rotation with respect to said outer cap member and foot part such that, upon rotation of said screwing sleeve, said piston is longitudinally displacable with respect to said outer cap member;

said foot part including locking means for releasably locking said foot part to said outer cap member; and said piston including an elastic locking projection which is dimensioned and arranged such that, when said piston is in a first position at the second end of said screwing sleeve, said locking projection is radially aligned with a locking opening provided in a wall of said foot part, and said locking projection having an internal spring force biasing said locking projection toward said locking opening, and said locking opening being shaped for locking engagement with said locking projection upon receipt of said locking projection in said locking opening, and said locking projection being dimensioned and arranged such that, when said releasable locking means is in locking engagement with said foot part and said piston is in said first position, said locking projection is placed in a non-engagement state with respect to the locking opening by the radial projection of said outer cap member.

2. A cosmetic stick holder as recited in claim 1 wherein said locking means releasably locking said foot part to said outer cap member includes an axial shoulder formed in said foot part which is dimensioned to releasably engage with the radial projection of said outer cap member.

3. A cosmetic stick holder as recited in claim 2 wherein said foot part further comprises a first guiding groove extending obliquely to a longitudinal axis of said slot sleeve and opening into one end of said axial shoulder, and a second guiding groove extending longitudinally and opening into an opposite end of said axial shoulder, said first and second guiding grooves being dimensioned so as to provide a camming surface with respect to the radial projection of said outer cap member.

4. A cosmetic stick holder as recited in claim 3 wherein said second guiding groove opens out at an outlet opening formed in a bottom portion of said foot part so as to allow for disengagement of said foot part and outer cap following rotation of said outer cap and subsequent longitudinal separation wherein said radial projection first slides along said axial shoulder and then along said second guiding groove and out through the outlet opening.

5. A cosmetic stick holder as recited in claim 3 wherein said axial shoulder and second guiding groove are dimensioned and arranged such that rotation of said outer cap causes said radial projection to ride along said axial shoulder and into said second guiding groove so as to disengage said radial projection from contact with said locking projection when said locking projection is aligned with said locking opening.

6. A cosmetic stick holder as recited in claim 3, further comprising an elastic part biasing said outer cap member longitudinally away from said foot part such that said radial projection is biased into contact with said foot part.

7. A cosmetic stick holder as recited in claim 6 wherein said elastic part includes an elastic tongue extension extending off of a base portion of said outer cap member and into contact with a base portion of said foot part.

8. A cosmetic stick holder as recited in claim 7 wherein said elastic tongue extension includes a head member and said base portion of said foot member includes a recess which is dimensioned to receive said head member so as to prevent free rotation of said outer cap with respect to said foot part.

9. A cosmetic stick holder as recited in claim 6 wherein said locking opening is formed so as to open into said axial shoulder.

10. A cosmetic stick holder as recited in claim 9 wherein said locking opening is formed above said axial shoulder and said axial shoulder includes a snapping depression below said locking opening for receipt of said radial projection.

11. A cosmetic stick holder as recited in claim 2 wherein said locking opening is formed above said axial shoulder.

12. A cosmetic stick holder as recited in claim 11 wherein said axial shoulder includes a snapping depression for receipt of said radial projection which is shaped as a round lug.

13. A cosmetic stick holder as recited in claim 1 wherein said foot part includes a central hollow portion an said locking opening formed in said foot part extends from and exterior surface of said foot part and opens into said central hollow portion.

14. A cosmetic stick holder as recited in claim 13 wherein said piston includes a cylindrical projection which extends into the central hollow portion and includes a snapping knob which is received in a corresponding notch formed in said foot part.

15. A cosmetic stick holder as recited in claim 13 wherein said locking projection includes an end head member which extends into said locking opening when said locking projection is received within said locking opening to a position radially inward of the exterior surface of said foot part.

16. A cosmetic stick holder as recited in claim 15 wherein a skin membrane is formed over the locking opening and is adapted for destruction upon extension of said radial projection into said locking opening.

17. A cosmetic stick holder as recited in claim 1 wherein a skin membrane is formed over the locking opening and is adapted for destruction upon extension of said radial projection into said locking opening.

* * * * *